US006977373B2

(12) United States Patent
Yoshinari et al.

(10) Patent No.: US 6,977,373 B2
(45) Date of Patent: Dec. 20, 2005

(54) ION TRAP MASS ANALYZING APPARATUS

(75) Inventors: Kiyomi Yoshinari, Hitachi (JP); Yoshiaki Kato, Mito (JP); Tadao Mimura, Hitachinaka (JP); Masaru Tomioka, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 10 days.

(21) Appl. No.: 10/846,529

(22) Filed: May 17, 2004

(65) Prior Publication Data

US 2004/0211898 A1 Oct. 28, 2004

Related U.S. Application Data

(63) Continuation of application No. 10/252,699, filed on Sep. 24, 2002, now Pat. No. 6,759,652.

(30) Foreign Application Priority Data

Feb. 12, 2002 (JP) ..... 2002-033307

(51) Int. Cl.[7] ..... H01J 49/42

(52) U.S. Cl. ..... 250/292; 250/281; 250/282; 250/290; 250/291

(58) Field of Search ..... 250/292, 281, 250/282, 290, 291, 293

(56) References Cited

U.S. PATENT DOCUMENTS 5,291,017 A * 3/1994 Wang et al. ..... 250/292
5,468,958 A 11/1995 Franzen et al.
5,569,917 A 10/1996 Buttrill, Jr. et al.
5,693,941 A * 12/1997 Barlow et al. ..... 250/292
5,714,755 A * 2/1998 Wells et al. ..... 250/281
5,763,878 A * 6/1998 Franzen ..... 250/292
6,294,780 B1 9/2001 Wells et al.
2002/0008198 A1 * 1/2002 Kasten et al. ..... 250/292

FOREIGN PATENT DOCUMENTS

DE 4017264 A1 12/1991
EP 0863537 A1 9/1998

OTHER PUBLICATIONS

Maurizio Splendore, et al., *A New Ion Ejection Method Employing An Asymmetric Trapping Field to Improve The Mass Scanning Performance Of An Electrodynamic Ion Trap, International Journal of Mass Spectrometry 190/191* (1999), pps. 129-143.

Lynn A. Gill, et al., *In Situ Optimization Of The Electrode Geometry Of The Quadrupole Ion Trap*, International Journal of Mass Spectrometry 188 (1999), pps. 87-93.

* cited by examiner

*Primary Examiner*—Nikita Wells
*Assistant Examiner*—James J. Leybourne
(74) *Attorney, Agent, or Firm*—Dickstein Shapiro Morin & Oshinsky LLP

(57) ABSTRACT

An ion-trap mass analyzing apparatus having means for generating ion-capture electric fields asymmetrical with respect to a reference plane containing a central point of a ring electrode and perpendicular to a central axis of the ring electrode in the inside of an ion trap to resonantly amplify ions rapidly to emit the ions from the ion trap in a short time to thereby permit high-sensitive high-accurate mass analysis stably regardless of the structural stability of ions as a subject of analysis.

5 Claims, 15 Drawing Sheets

SIMULATION CONDITION : ION MASS NUMBER 484 amu
RF VOLTAGE FREQUENCY $\Omega/2\pi = 770$ kHz
AUXILIARY AC VOLTAGE Vd = 5 V
AUXILIARY AC VOLTAGE FREQUENCY $\omega/2\pi = 465$ kHz
SCANNING SPEED Vscan = 240 μs/amu
SCANNING START M = 465 amu SIMULATION CONDITION : ION MASS NUMBER 484 amu
RF VOLTAGE FREQUENCY $\Omega/2\pi = 770$ kHz
AUXILIARY AC VOLTAGE Vd = 5.83 V
AUXILIARY AC VOLTAGE FREQUENCY $\omega/2\pi = 465$ kHz
SCANNING SPEED Vscan = 240 μs/amu
SCANNING START M = 465 amu SIMULATION CONDITION : ION MASS NUMBER 484 amu
RF VOLTAGE FREQUENCY $\Omega/2\pi = 770$ kHz
AUXILIARY AC VOLTAGE Vd = 5 V
AUXILIARY AC VOLTAGE FREQUENCY $\omega/2\pi = 256.6$ kHz
SCANNING SPEED Vscan = 240 μs/amu
SCANNING START M = 465 amu

ION TRAP MASS ANALYZING APPARATUS

CROSS-REFERENCE TO RELATED APPLICATION

This application is a continuation of U.S. patent application Ser. No. 10/252,699, filed on Sep. 24, 2002, U.S. Pat. No. 6,759,652, which is incorporated herein by reference.

BACKGROUND OF THE INVENTION

The present invention relates to an ion-trap mass analyzing apparatus in which an RF electric field is generated in an inter-electrode space to once stably capture all ion species contained in a sample, resonate target ions as a subject of mass separation and emit the target ions from the inter-electrode space to thereby perform mass separation.

In a conventional ion-trap mass analyzing apparatus, an electric field is generated symmetrically on ion inlet and outlet sides in order to keep z-direction oscillation of ions uniform.

For example, in U.S. Pat. No. 5,693,941, two end cap electrodes are disposed so as to be asymmetrical with respect to the central point of a ring electrode but a voltage applied between the two end cap electrodes is adjusted to generate an electric field in an inter-electrode space symmetrically on the ion inlet and outlet sides. Because the voltages themselves applied to the two end cap electrodes are made asymmetrical in accordance with the positional asymmetry of the two end cap electrodes, the internal electric field becomes symmetrical. As a result, the number of ions passing through an aperture in the end cap electrode on the side where a detector is disposed is increased without change in the behavior of ions compared with a conventional symmetrical ion trap to thereby attain improvement of sensitivity.

The conventional ion-trap mass analyzing apparatus has a problem as follows. That is, a mass shift phenomenon that the position of a mass peak is displaced from a position indicating a correct ion mass number may occur.

SUMMARY OF THE INVENTION

An object of the invention is to provide an ion-trap mass analyzing apparatus which can perform high-sensitive high-accurate mass analysis stably.

An advantage of the invention is that the ion-trap mass analyzing apparatus has means by which a RF electric field asymmetrical with respect to the center of a ring electrode is generated in the inside of an ion trap to resonate and amplify ions rapidly to thereby emit the ions from the ion trap in a short time.

Above and other advantages of the invention will become clear from the following description.

Other objects, features and advantages of the invention will become apparent from the following description of the embodiments of the invention taken in conjunction with the accompanying drawings.

DETAILED DESCRIPTION OF THE INVENTION

Embodiments of the invention will be described below with reference to the drawings.

Figure 2:
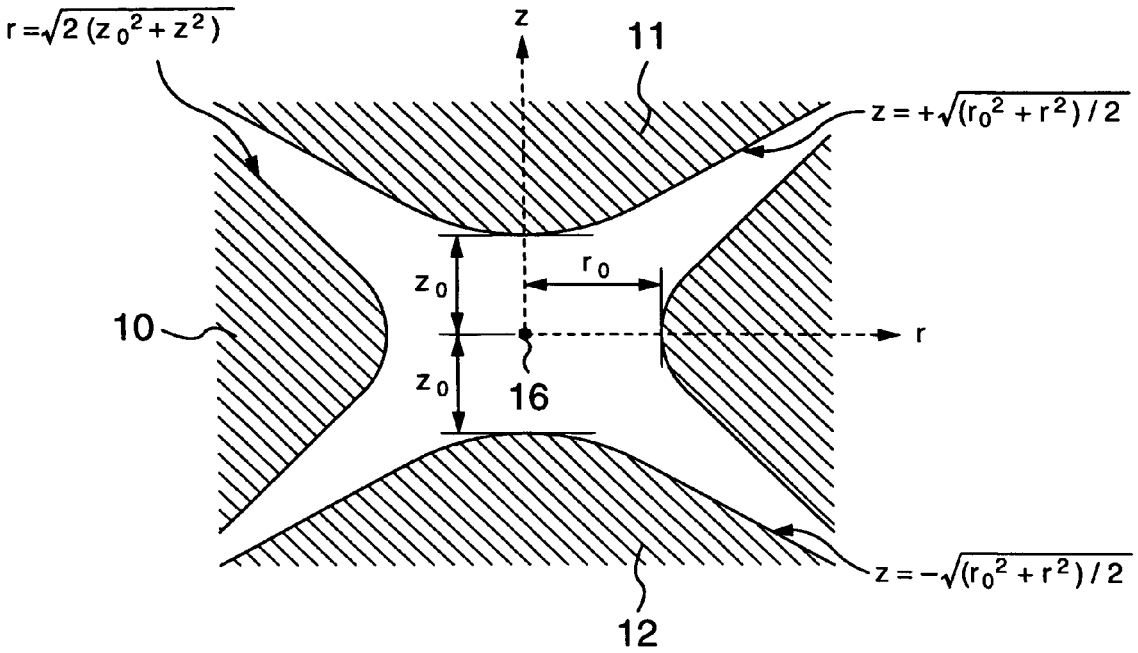
FIG. 2 is a sectional view of respective electrodes in an ion trap.

As shown in FIG. 2, an ion trap which is a mass analysis section in an ion-trap mass analyzing apparatus is theoretically constituted by a ring electrode 10 and two end cap electrodes 11 and 12 arranged in opposite directions so as to sandwich the ring electrode 10. The ring electrode 10 has a hyperbolic surface. The two end cap electrodes 11 and 12 have hyperbolic surfaces different from that of the ring electrode 10. A DC voltage U and a radio-frequency voltage $V_{RF}\cos\Omega t$ are applied between the electrodes to generate a quadrupole electric field in a space between the electrodes. Hereinafter, the ring electrode 10 and the two end cap electrodes 11 and 12 are generically referred to as ion-trap electrodes. The potential distribution generated in the space between the ion-trap electrodes on this occasion is given by the equation:

Quadrupole Potential Distribution:

$$\Phi_4=\phi_0(r^2-2z^2)/r_0^2 \quad (1)$$

in which $\phi_0$ is defined as $\phi_0=U+V_{RF}\cos\Omega t$, $r_0$ is the inner diameter of the ring electrode, $z_0$ is the distance from the central point 16 of the ring electrode to each end cap electrode, and (r, z) are coordinates of a point in a coordinate system with the central point 16 of the ring electrode as its origin.

Theoretically, $r_0$ and $z_0$ have the relation $z_0=r_0/\sqrt{2}$. The stability of trajectories of ions trapped in the electric field generated by the potential distribution given by the equation (1) is decided on the basis of the apparatus size (the inner diameter $r_0$ of the ring electrode), the DC voltage U applied between the electrodes, the amplitude $V_{RF}$ and angular frequency $\Omega$ of the radio-frequency voltage applied between the electrodes and, moreover, values a and q given by the mass-to-charge ratio m/Z of ions (equation (2)).

$$a=8eU/(mr_0^2\Omega^2),\ q=4eV/(mr_0^2\Omega^2) \quad (2)$$

in which Z is the number of charges of ions, m is mass, and e is elementary charge.

Figure 3:
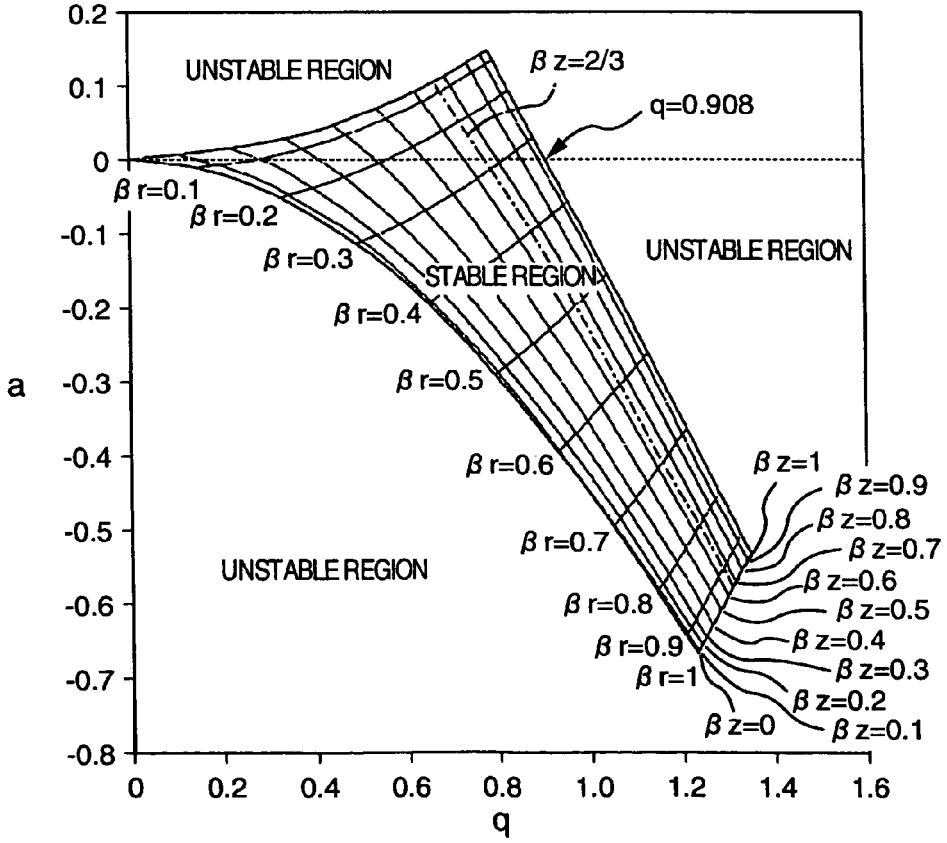
FIG. 3 is a graph of a stable region of values a and q which decide stability of ion trajectories in the ion trap.

FIG. 3 is a graph of a stable region showing the range of (a, q) providing stable trajectories in the space between the ion-trap electrodes. Generally, because only the radio-frequency voltage $V_{RF}\cos\Omega t$ (RF drive voltage) is applied to the ring electrode, all ions corresponding to points on a straight line a=0 in the stable region are stably oscillated in the inter-electrode space and trapped in the inter-electrode space. On this occasion, the ions are arranged in a range of from q=0 to q=0.908 on the a axis in order of decreasing value in the mass-to-charge ratio m/z according to the equation (2) on the basis of difference in the point (0, q) on the stable region (FIG. 3) in accordance with the mass-to-charge ratio. Accordingly, in an ion-trap mass spectrometer, all ion species having values of the mass-to-charge ratio (m/z) in a certain range are once stably trapped, but, on this occasion, the ions oscillate at different frequencies in accordance with the values of the mass-to-charge ratio (m/z). This respect is used as follows. That is, an auxiliary AC electric field at a specific frequency is superposed on the space between the ion-trap electrodes to thereby emit ions resonating with the auxiliary AC electric field from the space between the ion-trap electrodes to thereby perform mass separation.

Figure 4:
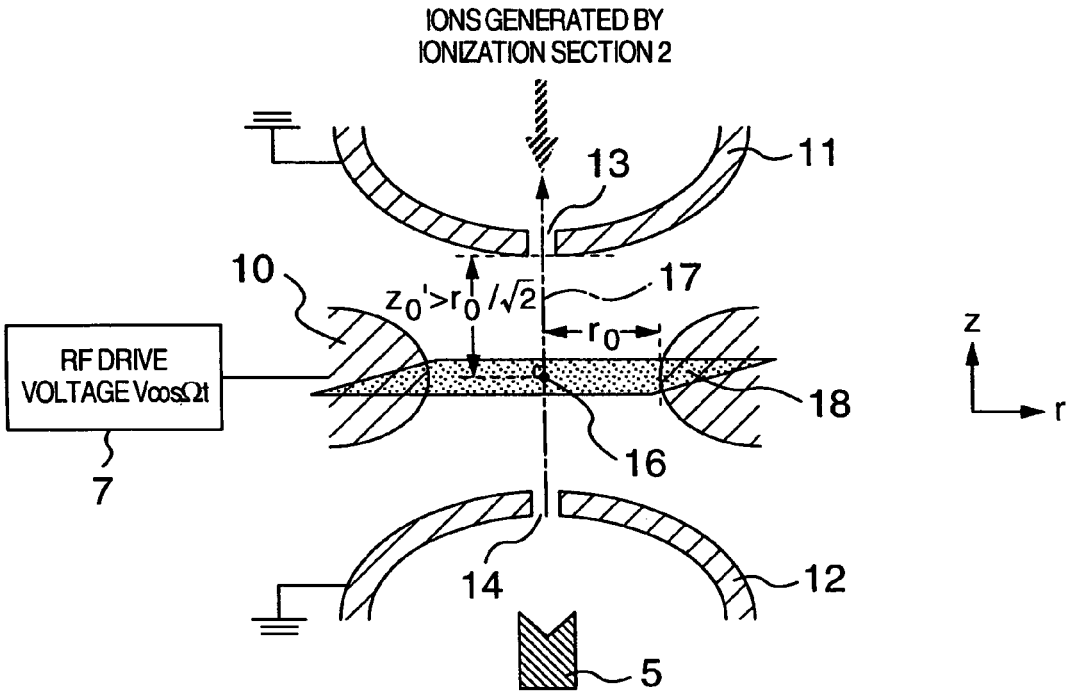
FIG. 4 is a view for explaining an example of a real ion trap.

As shown in FIG. 4, in the real ion trap, an ion inlet 13 which is an opening for injecting sample ions into the space between the ion-trap electrodes and an ion outlet 14 which is an opening for ejecting ions from the space between the ion-trap electrodes may be provided in the end cap electrodes 11 and 12 respectively or the distance between the end cap electrodes may be selected and arranged to be larger than the theoretical distance ($2z_0=\sqrt{2}r_0$). That is, the real ion trap is different from the ideal ion trap in terms of the shape and arrangement thereof. Accordingly, besides the quadrupole electric field, multipole electric fields are slightly generated in the space between the real ion-trap electrodes. Typical 2n-pole potential distributions $\Phi_{2n}$ (n=3 to 6) are specifically given by the following equations:

n=3 Hexapole Potential Distribution:

$$\Phi_6=C_3(z^3-3zr^2/2) \quad (3)$$

n=4 Octpole Potential Distribution:

$$\Phi_8=C_4(z^4-3z^2r^2+3r^4/8) \quad (4)$$

n=5 Decapole Potential Distribution:

$$\Phi_{10}=C_5(z^5-5z^3r^2+15zr^4/8) \quad (5)$$

n=6 Dodecapole Potential Distribution:

$$\Phi_{12}=C_6(z^6-15z^4r^2/2+45z^2r^4/8-5r^6/16) \quad (6)$$

in which the origin of the r-z coordinate system is the central point 16 of the ring electrode as shown in FIG. 4, and $C_n$ is a coefficient in each term.

Figure 5:
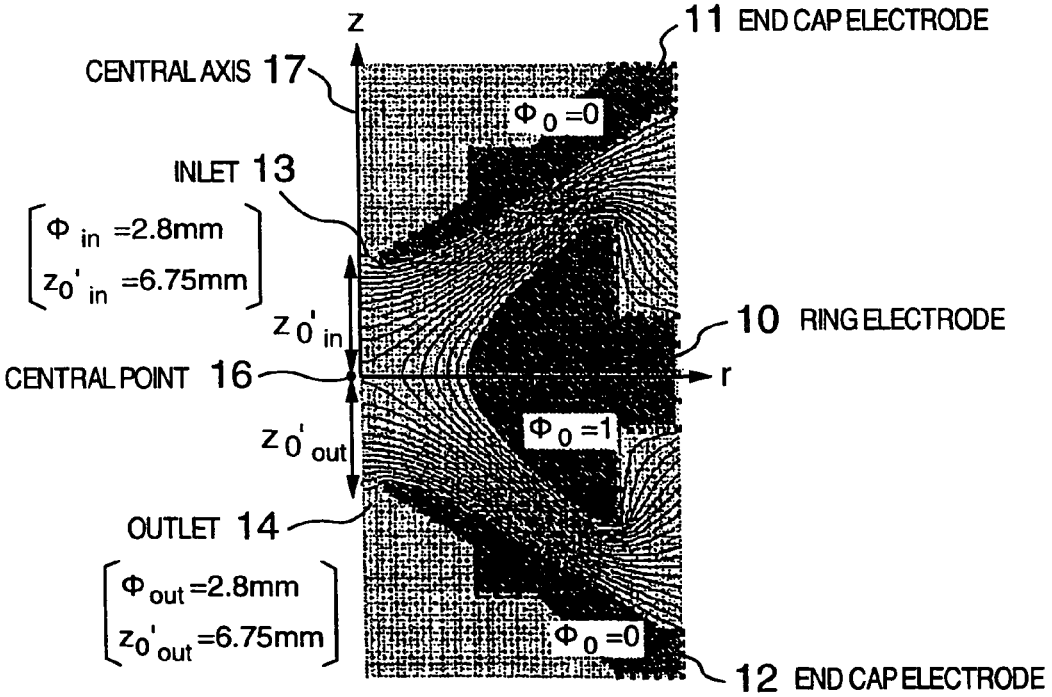
FIG. 5 is a view of an example of an equipotential map in an r-z coordinate system in the case where the potential of each of the end cap electrodes is $\phi_0=0$ in the ion trap on the assumption that the potential of the ring electrode is $\phi_0=1$ as unit potential.
Figure 6:
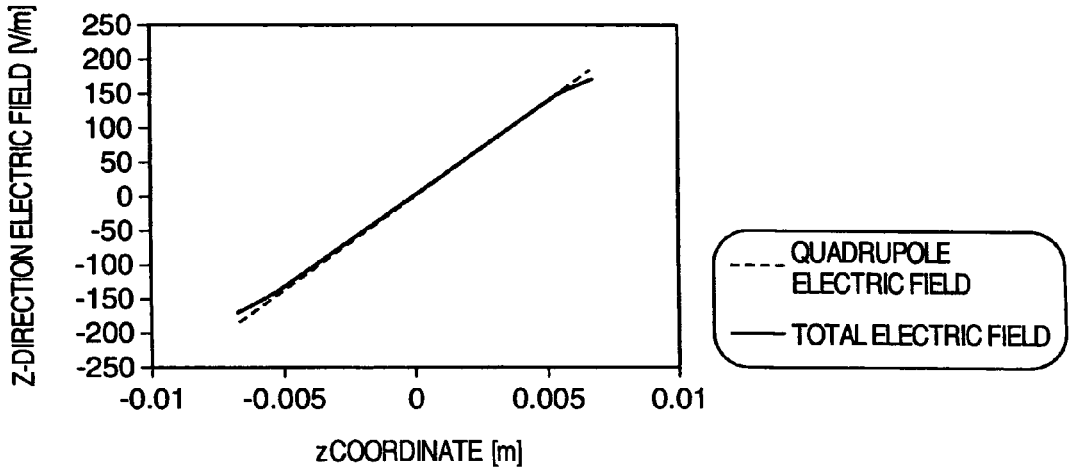
FIG. 6 is a graph for explaining an example of z-direction electric field at r=0 in the case where the potential of each of the end cap electrodes is $\phi_0=0$ in the ion trap on the assumption that the potential of the ring electrode is $\phi_0=1$ as unit potential.
Figure 7:
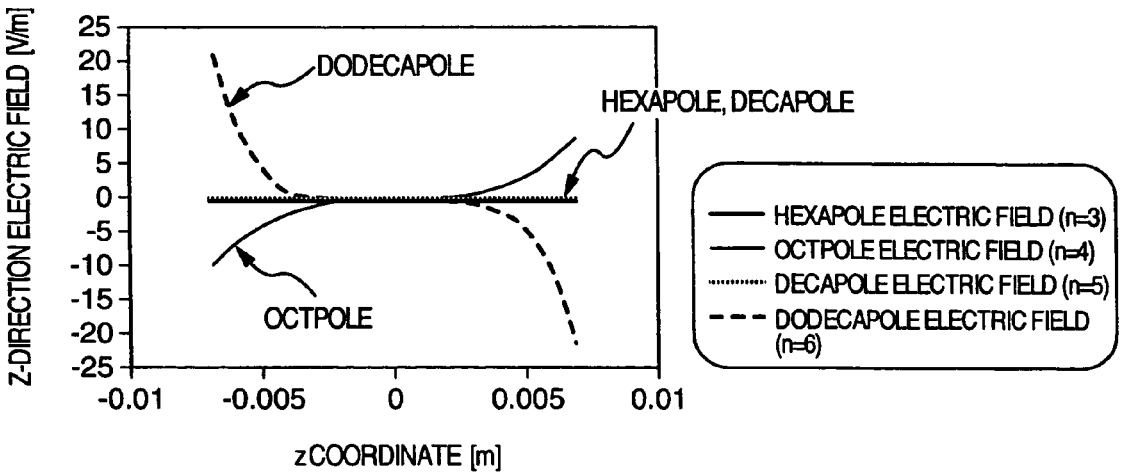
FIG. 7 is a graph for explaining an example of z-direction electric field at r=0 in the case where the potential of each of the end cap electrodes is $\phi_0=0$ in the ion trap on the assumption that the potential of the ring electrode is $\phi_0=1$ as unit potential.

When the equations (3) to (6) are differentiated in r and z directions respectively, r-direction and z-direction multipole electric fields are calculated. Generally, as shown in FIG. 4, one end cap electrode 11 has an ion inlet 13 and the other end cap electrode 12 has an ion outlet 14. When the internal electric field distribution is symmetrical on the ion inlet and outlet sides with respect to the reference plane 18 containing the central point 16 of the ring electrode and perpendicular to the rotation symmetry axis of the ring electrode 10, an octpole electric field, a dodecapole electric field, . . . , a 2m-pole electric field, . . . at n=4, 6, . . . , 2m, . . . (even-numbered terms) are slightly generated but a hexapole electric field, a decapole electric field, . . . , (2m+1)-pole electric field, . . . at n=3, 5, . . . , 2m+1, . . . (odd-numbered terms) are little generated. When the electrodes are shaped symmetrically with respect to the reference plane 18 as shown in FIG. 4, the potential distribution and electric fields generated in the inter-electrode space are calculated by numerical analysis methods. Incidentally, the potential distribution and electric fields are calculated on the assumption that the potential of each of the end cap electrodes is $\phi_0=0$ whereas the potential of the ring electrode 10 is $\phi_0=1$ as unit potential in the case where the ion inlet 13 and the ion outlet 14 are both $\Phi=2.8$ mm in opening diameter and the distances from the central point 16 of the ring electrode to the end cap electrodes 11 and 12 are both $z_0'=6.75$ mm, as shown in FIG. 5. FIG. 5 shows a view of the thus obtained equipotential map in the r-z coordinate system. FIGS. 6 and 7 show the obtained z-direction electric fields at r=0. As shown in FIG. 6, a point at which the total electric field is zero substantially coincides with the central point 16 of the ring electrode (z=0), so that the total electric field has a symmetrical distribution with respect to the central point 16 of the ring electrode. It is also obvious that the ratio of the intensity of quadrupole electric field to the intensity of total electric field is high, and that the hexapole electric field and the decapole electric field at n=3 and 5 (odd-numbered terms) are little generated whereas the octpole electric field and the dodecapole electric field are intensive, judging from the difference between the total electric field and the quadrupole electric field, that is, judging from multipole electric fields (FIG. 7) other than the quadruple electric field.

Figure 10:
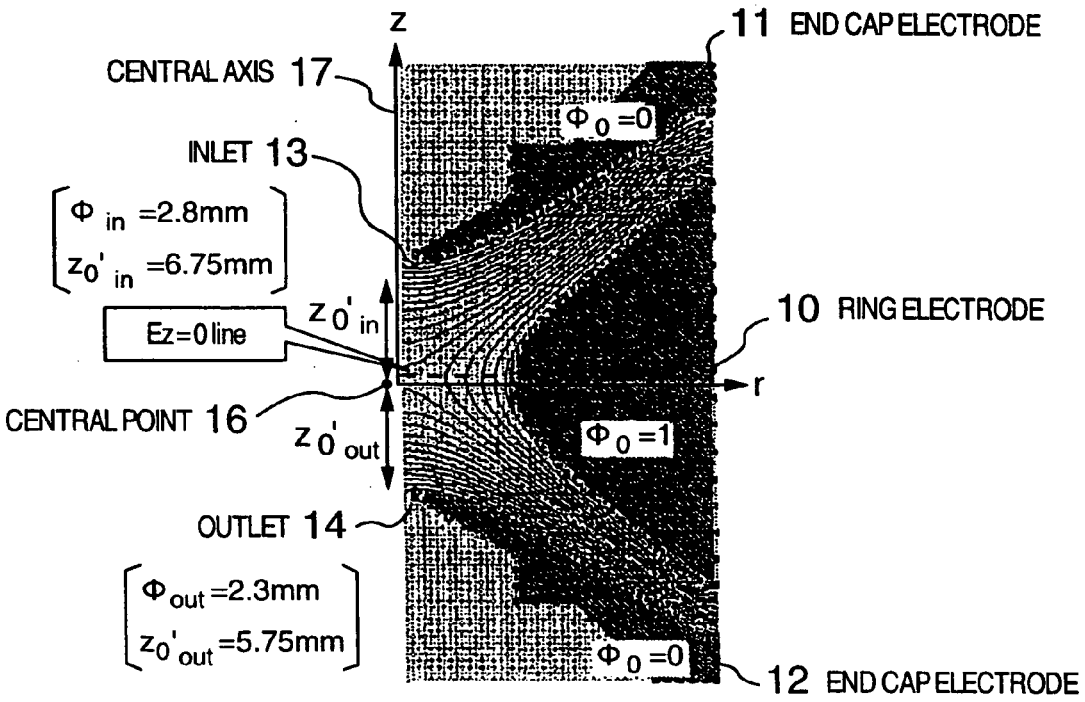
FIG. 10 is a graph for explaining an example of a result of numerical analysis of the internal electric potential distribution generated in the space between the ion-trap electrodes in the case where the electrodes are shaped so that the electric field distribution is asymmetrical with respect to the reference plane.
Figure 11:
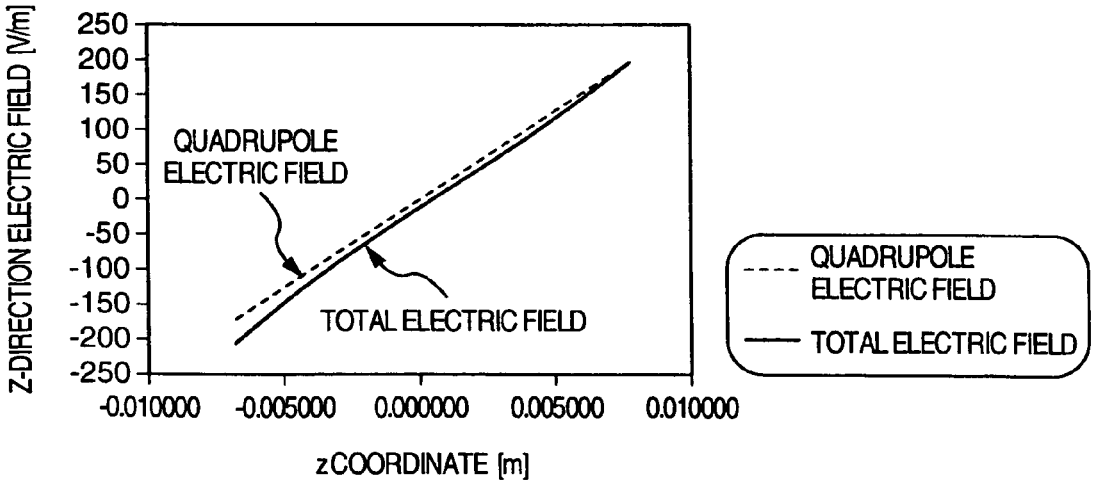
FIG. 11 is a graph for explaining an example of a result of numerical analysis of the internal electric field distribution generated in the space between the ion-trap electrodes in the case where the electrodes are shaped so that the internal electric field distribution is asymmetrical with respect to the reference plane.
Figure 12:
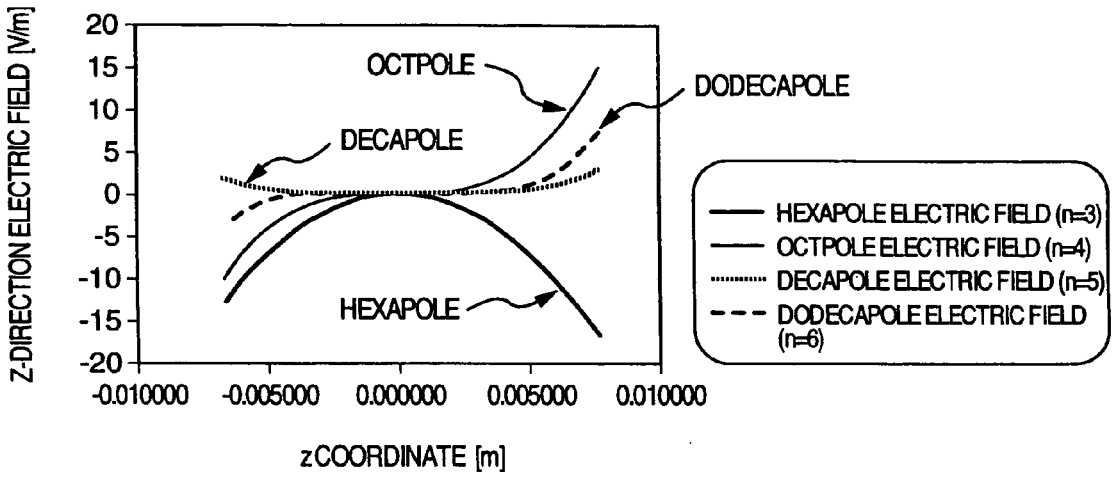
FIG. 12 is a graph for explaining an example of a result of numerical analysis of the internal electric field distribution generated in the space between the ion-trap electrodes in the case where the electrodes are shaped so that the internal electric field distribution is asymmetrical with respect to the reference plane.

On the other hand, when the internal electric field distribution is asymmetrical with respect to the reference plane 18 containing the central point 16 of the ring electrode and perpendicular to the central axis 17 of the ring electrode, the intensity of the hexapole and decapole electric fields at n=3 and 5 (odd-numbered terms) increases compared with the symmetrical electric field distribution shown in FIGS. 5, 6 and 7. FIGS. 10, 11 and 12 show results of the internally generated potential distribution and electric fields calculated by numerical analysis when the electrodes are shaped so that the internal electric field distribution is asymmetrical with respect to the reference plane 18. Incidentally, the potential distribution and electric fields are calculated on the assumption that the potential of each of the end cap electrodes is $\phi_0=0$ whereas the potential of the ring electrode is $\phi_0=1$ as unit potential in the case where the diameter of the ion inlet 13 and the diameter of the ion outlet 14 are $\Phi_{in}=1.8$ mm and $\Phi_{out}=1.3$ mm respectively and the distances from the central point 16 of the ring electrode to the end cap electrodes 11 and 12 are $z_0'_{in}=6.75$ mm and $z_0'_{out}=5.75$ mm respectively as shown in FIG. 10. FIG. 10 shows the obtained equipotential map in the r-z coordinate system. FIGS. 11 and 12 show the obtained z-direction electric fields at r=0. As shown in FIG. 11, the point at which the total electric field is zero does not coincide with the central point 16 of the ring electrode (z=0), so that the total electric field has an asymmetrical distribution with respect to the central point 16 of the ring electrode. It is also obvious from FIG. 12 that hexapole and decapole electric fields at n=3 and 5 (odd-numbered terms) as well as octpole and dodecapole electric fields are generated as multipole electric fields other than the quadrupole electric field. In an ordinary ion-trap mass analyzing apparatus, an electric field symmetrical on the ion inlet and outlet sides is generated to keep z-direction oscillation of ions uniform.

Generally, because neutral gas such as helium gas is existing in the space between the ion-trap electrodes, ions trapped in the space collide with the neutral gas repeatedly. Structurally unstable ions are dissociated by the collision with the neutral gas. The probability of ions' dissociation due to the collision with the helium gas increases while the ions resonate with the auxiliary AC electric field superposedly applied on the space between the ion-trap electrodes to thereby amplify ion oscillation, that is, just before the ions are resonantly emitted from the space. If the point (a, q) of a fragment ion smaller in mass number than its parent ion is equivalent to a point out of the stable region shown in FIG. 3 on this occasion, the ion is emitted from the space between the ion-trap electrodes at the moment of dissociation and counted as an ion of mass to be emitted in this timing. Because ions oscillate resonantly likewise, there is the possibility that energy obtained by ions' collision with the neutral gas may exceed ionic bond energy, that is, ions may be dissociated substantially at once if the ions can be easily dissociated. On this occasion, there is the possibility that a mass shift phenomenon may occur so that the position of a mass peak is displaced from a position indicating a correct ion mass number to the low mass number side. The mass shift phenomenon must be avoided because there is a possibility that this phenomenon may cause recognition error of the result of analysis.

Figure 1:
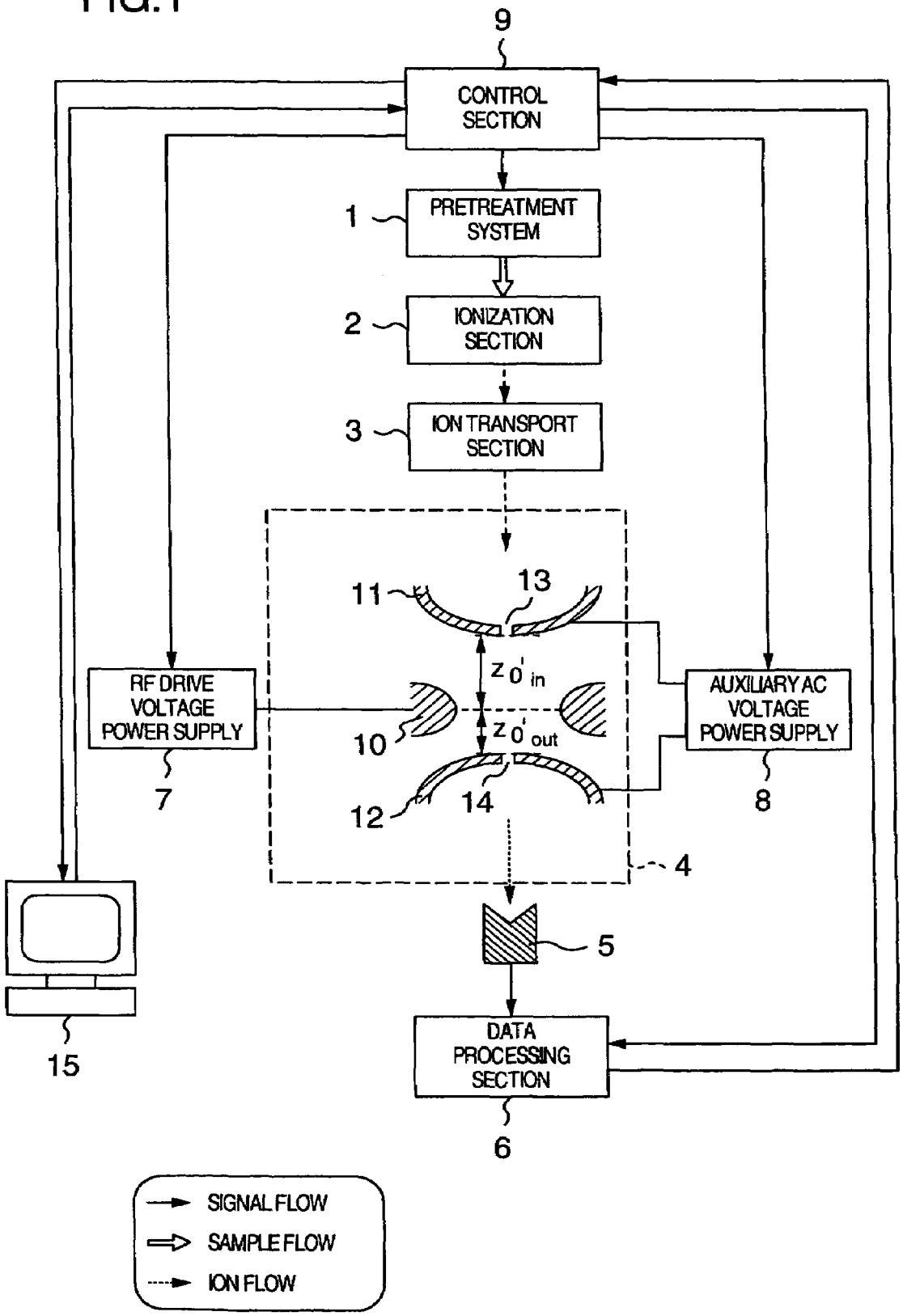
FIG. 1 is a schematic diagram showing the overall configuration of an ion-trap mass analyzing apparatus according to a first embodiment of the invention.

A first embodiment of the invention will be described first. FIG. 1 is a schematic diagram showing the overall configuration of an ion-trap mass analyzing apparatus according to the first embodiment of the invention. A mixture sample as a subject of mass analysis is separated into components by a preparation system 1 such as gas chromatography or liquid chromatography and then ionized by an ionization section 2. An ion-trap mass analysis section 4 is constituted by a ring electrode 10 and two end cap electrodes 11 and 12 disposed opposite to each other so as to sandwich the ring electrode 10. An RF electric field for trapping ions is generated in an inter-electrode space by an RF drive voltage $V_{RF}$ cos $\Omega t$ supplied to the ring electrode 10 by an RF drive voltage power supply 7. Ions generated by the ionization section 2 pass through an ion inlet 13 of the end cap electrode 11 via an ion transport section 3 and enter the inter-electrode space between the ring electrode 10 and the end cap electrodes 11 and 12. After the ions are once stably trapped by the RF electric field, ions having different mass-to-charge ratios are mass-separated (mass-scanning-analyzed) successively. On this occasion, an auxiliary AC voltage power supply 8 applies an auxiliary AC voltage at a single frequency between the end cap electrodes 11 and 12 to generate an auxiliary AC electric field to thereby excite resonance of one specific ion species to eject the specific ion species from the space between the ion-trap electrodes for mass separation. Generally, because the auxiliary AC voltage at a constant frequency is applied, the mass-to-charge ratios of ions as a target of mass separation can be emitted successively by scanning of the amplitude $V_{RF}$ of the RF drive voltage $V_{RF}$ cos $\Omega t$ on the basis of the relation according to the equation (2). Among the ions emitted from the inter-electrode space in this manner, ions passing through the ion outlet 14 of the end cap electrode 12 are detected by a detector 5 and processed by a data processing section 6. This series of mass analyzing steps: [ionization of the sample, transport and entrance of sample ion beams into the ion-trap mass analysis section, adjustment of the amplitude of the RF drive voltage at the time of entrance of sample ions, ejection of unnecessary ions from the space between the ion-trap electrodes, dissociation of parent ions (in case of tandem analysis), scan of the amplitude of the RF drive voltage (scan of the mass-to-charge ratio of ions to be mass-analyzed), and adjustment, detection and data processing of the amplitude of the auxiliary AC voltage and the kind and timing of the auxiliary AC voltage] is controlled as a aperture by a control section 9.

Figure 8:
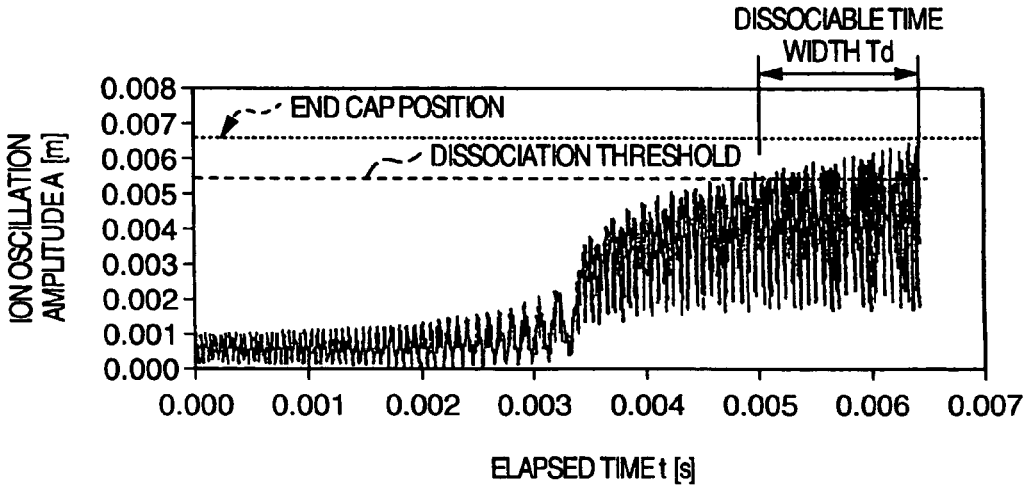
FIG. 8 is a graph for explaining an example of numerical analysis of ion trajectories in the case where ions trapped in a space between the ion-trap electrodes are resonantly emitted from the space for capturing ions.

Generally, as shown in FIGS. 5, 6 and 7, the RF electric field generated in the space between the ion-trap electrodes to capture ions has a symmetrical distribution on the ion inlet and outlet sides with respect to a reference plane 18 containing a central point 16 of the ring electrode 10 and perpendicular to a central axis 17 of the ring electrode. FIG. 8 shows results of numerical analysis of ion trajectories when the ion-capture electric field has a symmetrical distribution as shown in FIGS. 5 to 7 and when ions trapped in the inter-electrode space are resonantly emitted from the inter-electrode space at the time of further application of $+v_d$ cos $\omega t$ and $-v_d$ cos $\omega t$ to the end cap electrodes 11 and 12 respectively, as shown in FIG. 4, to generate an auxiliary AC electric field superposed on the ion-trap electric field. It is obvious from FIG. 8 that the oscillation amplitude A of ions increases gradually in accordance with the elapsed time t, and that ions are finally emitted from the space between the ion-trap electrodes when the oscillation amplitude of ions reaches the end cap electrode position. As the oscillation amplitude A of ions increases, the oscillation energy of ions increases and the probability that ions will be dissociated by collision with the neutral gas such as the space between the ion-trap electrodes also increases. When the threshold of the oscillation amplitude A serving as oscillation energy for facilitating dissociation of ions is $A_t$ on this occasion, there is a high possibility that ions are dissociated in a time period $T_d$ in which oscillation with the amplitude higher than the threshold $A_t$ is repeated. Hence, there is a high possibility that mass shift may occur because ions are emitted earlier than the time the ions are supposed to be inherently emitted.

Figure 9:
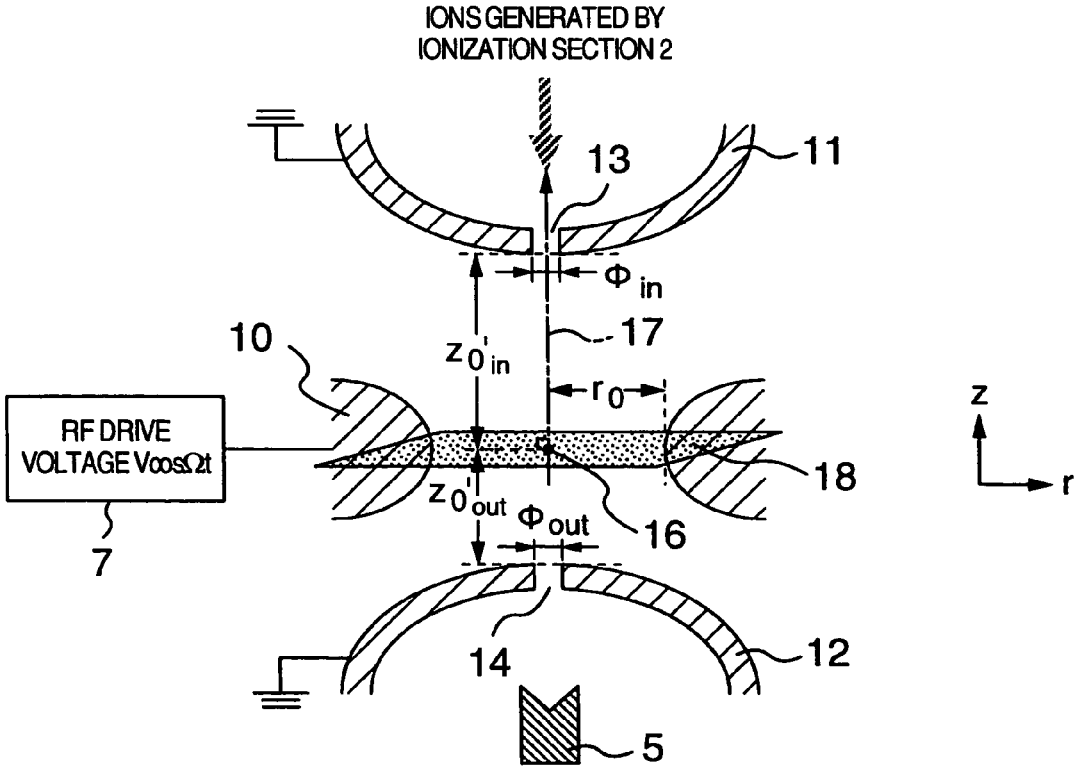
FIG. 9 is a view for explaining an example of the shapes of the ion-trap electrodes in the embodiment of the invention.
Figure 13:
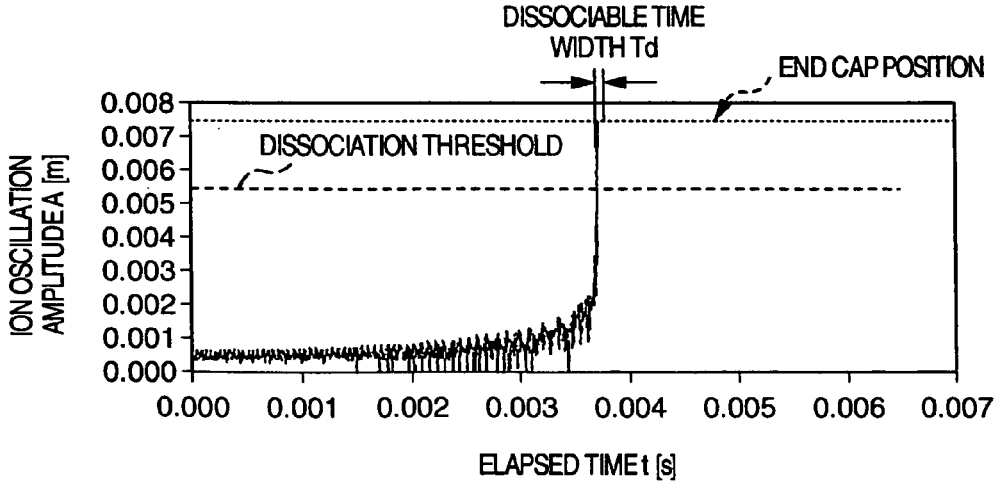
FIG. 13 is a graph for explaining an example of a result of numerical analysis of ion trajectories in the case where ions trapped in the space between the ion-trap electrodes are resonantly emitted from the space.

In this embodiment, as shown in FIG. 9, the electrodes are shaped asymmetrically with respect to the reference plane 18 containing the ring electrode central point 16 (which is the central point of the ring electrode 10) and perpendicular to the central axis 17 of the ion-tap electrodes so that the electric field generated in the inter-electrode space has an asymmetrical distribution on the ion inlet and outlet sides with respect to the reference plane 18. For example, as shown in FIG. 9, the shape and arrangement of the end cap electrodes 11 and 12 are selected so that the diameter $\Phi_{in}$ of the ion inlet 13 in the end cap electrode 11 is larger than the diameter $\Phi_{out}$ of the ion outlet 14 in the end cap electrode 12 ($\Phi_{in}>\Phi_{out}$), and so that the distance $z_0'_{in}$ from the ring electrode central point 16 to the ion inlet-side end cap electrode 11 is longer than the distance $z_0'_{out}$ from the ring electrode central point 16 to the ion outlet-side end cap electrode 12 ($z_0'_{in}>z_0'_{out}$). As an example of this embodiment, the potential distribution and electric fields are calculated by numerical analysis when the diameters of the ion inlet and outlet 13 and 14 are $\Phi_{in}$=1.8 mm and $\Phi_{out}$=1.3 mm respectively and the distances from the ring electrode central point 16 to the end cap electrodes 11 and 12 are $z_0'_{in}$=6.75 mm and $z_0'_{out}$=5.75 mm respectively as shown in FIG. 10 on the assumption that the potential of each of the end cap electrodes is $\phi_0$=0 whereas the potential of the ring electrode is $\phi_0$=1 as unit potential. FIG. 10 shows the obtained equipotential map in the r-z coordinate system. FIGS. 11 and 12 show the obtained z-direction electric fields at r=0. As shown in FIG. 11, the point at which the total electric field is zero does not coincide with the ring electrode central point 16 (z=0), so that the total electric field has an asymmetrical distribution with respect to the ring electrode central point 16. It is also obvious from FIG. 12 that hexapole and decapole electric fields at n= 3 and 5 (odd-numbered terms) as well as octpole and dodecapole electric fields are generated as multipole electric fields other than the quadrupole electric field. FIG. 13 shows results of numerical analysis of ion trajectories when the ion-capture electric field generated has an asymmetrical distribution as described above and when ions captured in the inter-electrode space are resonantly emitted from the inter-electrode space at the time of further application of $+v_d \cos \omega t$ and $-v_d \cos \omega t$ to the end cap electrodes 11 and 12 respectively, as shown in FIG. 9, to generate an auxiliary AC electric field superposed on the ion-trap RF electric field. It is obvious from FIG. 13 that the oscillation amplitude A of ions increases rapidly in accordance with the elapsed time t, and that ions are emitted from the space between the ion-trap electrodes in a short time after the oscillation amplitude of ions begins to be resonantly amplified. When the threshold of the oscillation amplitude A serving as oscillation energy for facilitating dissociation of ions is $A_t$ on this occasion, the time period $T_d$ in which oscillation with the amplitude higher than the threshold $A_t$ is repeated is very short. In this manner, the asymmetrical electric field is effective in destabilizing ions rapidly. Hence, in this case, the probability that ions will be dissociated becomes low, so that the possibility that mass shift may be caused by earlier ions' emission than the inherent time for the ions to be emitted becomes low. That is, according to this embodiment, ions so fragile in structure as to be easily dissociated can be restrained from being dissociated, so that mass shift can be avoided regardless of the structural stability of ions. As a result, it can be expected that high-accurate analysis can be performed stably. Further, in this embodiment, because the size of the ion inlet is selected to be larger than the size of the ion outlet, the amount of ions flowing into the space between the ion-trap electrodes can be increased so that improvement in sensitivity can be expected.

Figure 14:
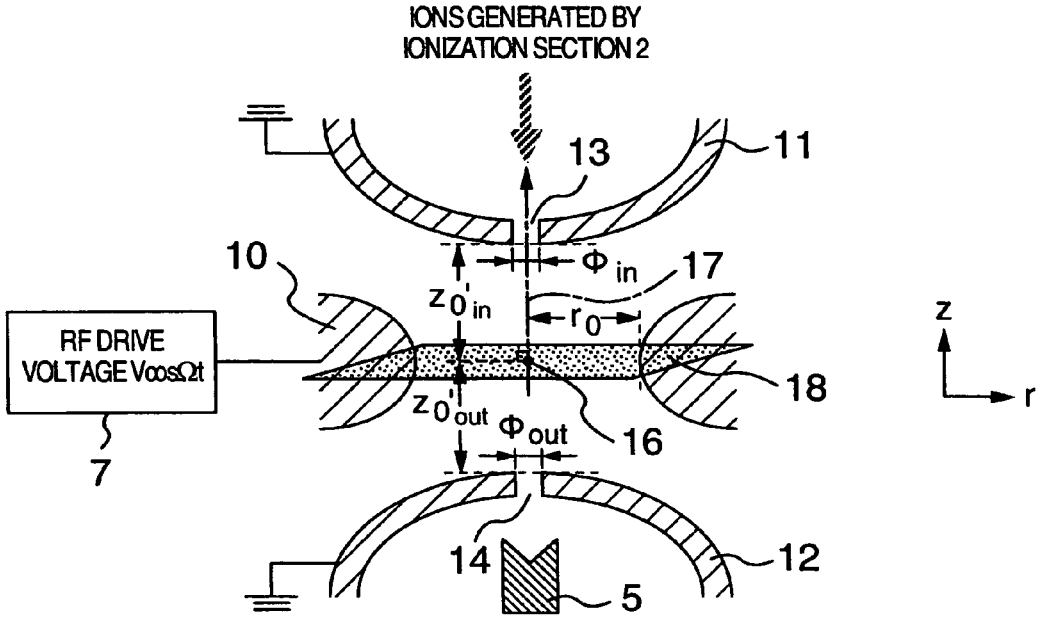
FIG. 14 is a view for explaining a second embodiment of the invention.

A second embodiment of the invention will be described below with reference to FIG. 14. In this embodiment, the aperture size $\Phi_{in}$ of the ion inlet 13 in the end cap electrode 11 is selected to be larger than the aperture size $\Phi_{out}$ of the ion outlet 14 in the end cap electrode 12 ($\Phi_{in}>\Phi_{out}$) to thereby generate an asymmetrical electric field in the space between the ion-trap electrodes. On this occasion, the asymmetrical electric field can be generated by a simple operation of changing the aperture sizes of the end cap electrodes without various change of the shapes of the electrodes. In addition, in this embodiment, the amount of ions injecting into the space between the ion-trap electrodes can be increased because $\Phi_{in}>\Phi_{out}$. Hence, improvement in sensitivity can be also expected.

Figure 15:
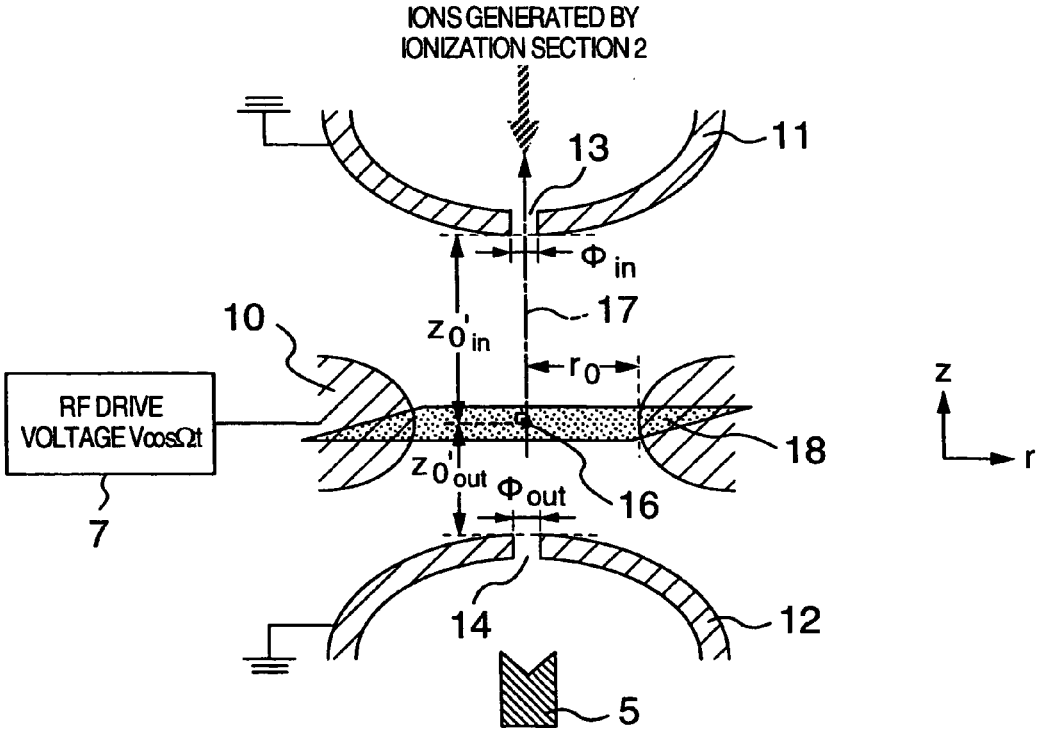
FIG. 15 is a view for explaining a third embodiment of the invention.

A third embodiment of the invention will be described below with reference to FIG. 15. In this embodiment, the distance $z_0'_{in}$ from the ring electrode central point 16 to the end cap electrode 11 is selected to be different from the distance $z_0'_{out}$ from the ring electrode central point 16 to the end cap electrode 12 ($z_0'_{in}\neq z_0'_{out}$) to thereby generate an asymmetrical electric field in the space between the ion-trap electrodes. On this occasion, the asymmetrical electric field can be generated by a simple operation of changing the distances from the ring electrode central point 16 to the end cap electrodes 11 and 12 without various change of the shapes of the electrodes. In addition, because the setting of the distances from the ring electrode central point 16 to the end cap electrodes 11 and 12 as $z_0'_{in}\neq z_0'_{out}$ is very efficient in generating the asymmetrical electric field, there is a high possibility that ions will be destabilized rapidly even in the case where the distances from the ring electrode central point 16 to the end cap electrodes 11 and 12 are slightly different from each other.

Figure 16:
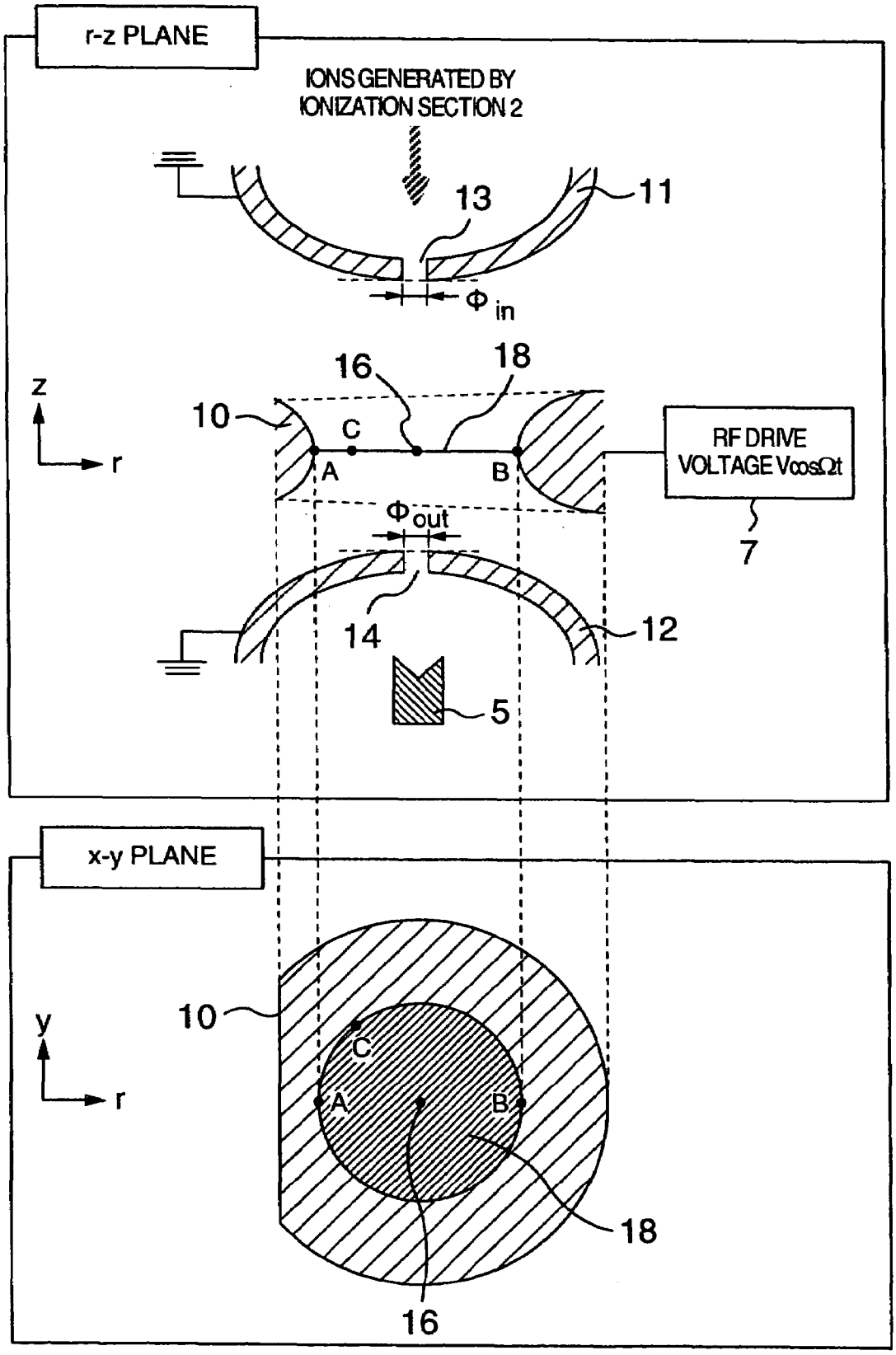
FIG. 16 is a view for explaining a fourth embodiment of the invention.

A fourth embodiment of the invention will be described below with reference to FIG. 16. In this embodiment, a plane containing at least three apex points on the convex surface of the ring electrode is used as the reference plane 18 for symmetry/asymmetry of the ion-capture electric field so that the center of a circle constituted by points of intersection between the plane and the convex surface of the ring electrode may be set as the ring electrode central point 16 in the reference plane 18. That is, as shown in FIG. 16, even in the case where the ring electrode 10 does not have a rotationally symmetrical shape because of limitation on arrangement, the ring electrode central point 16 and the reference plane 18 can be set practically according to this embodiment. That is, according to this embodiment, an asymmetrical electric field can be generated in the inter-electrode space on the basis of the appropriate central point 16 and the appropriate reference plane 18 even in the case where the ring electrode 10 does not have a rotationally symmetrical shape.

Figure 17:
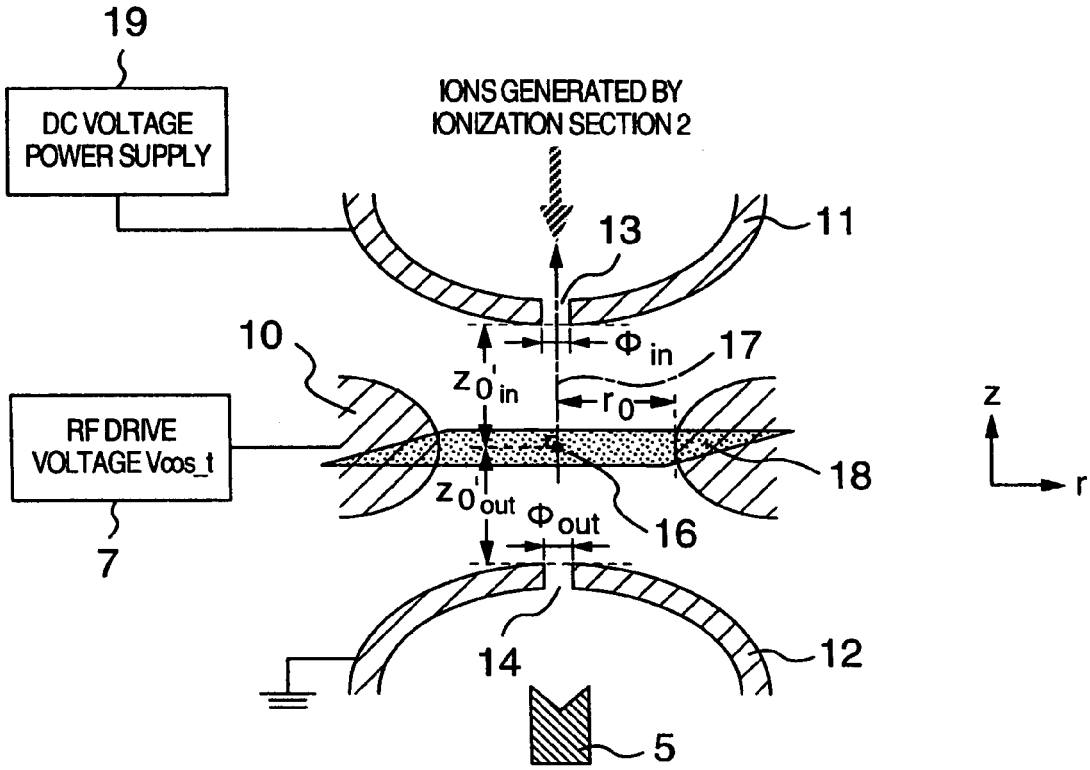
FIG. 17 is a view for explaining a fifth embodiment of the invention.
Figure 18:
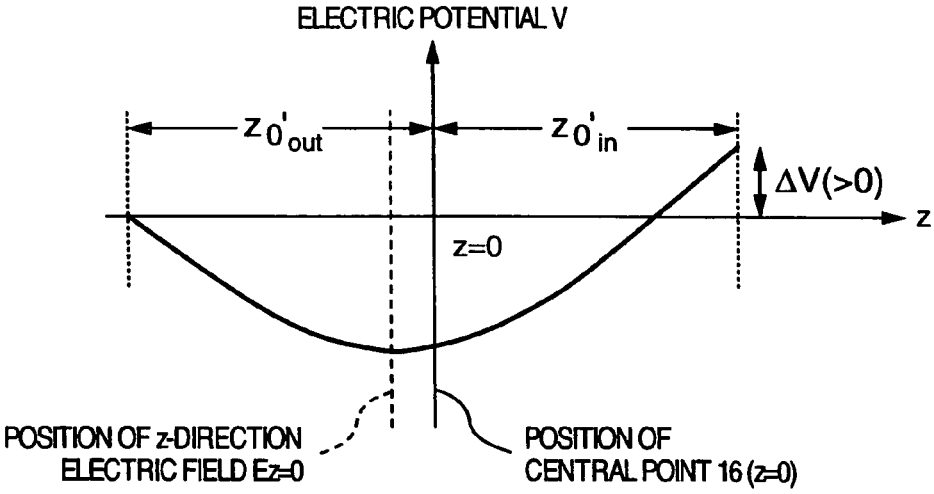
FIG. 18 is a graph for explaining the fifth embodiment of the invention.
Figure 19:
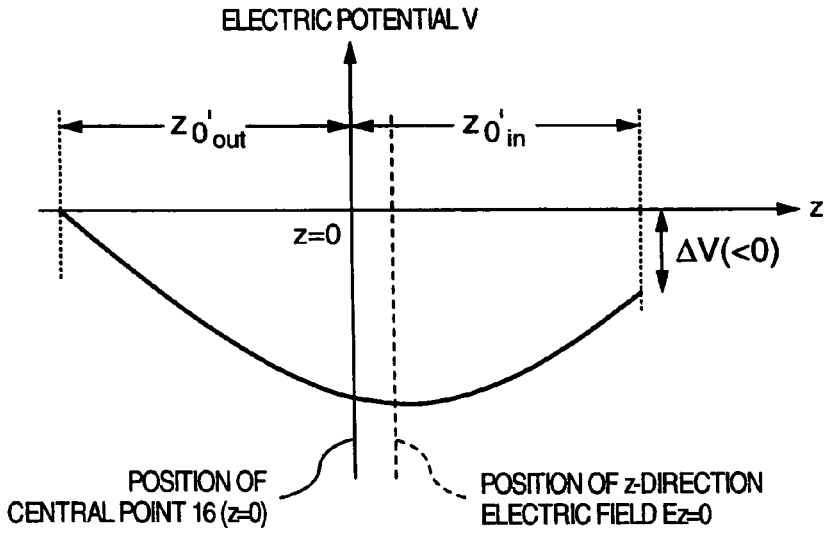
FIG. 19 is a graph for explaining the fifth embodiment of the invention.

A fifth embodiment of the invention will be described below with reference to FIGS. 17, 18 and 19. In this embodiment, the ring electrode 10 and the end cap electrodes 11 and 12 may be shaped symmetrically with respect to the reference plane 18 perpendicular to the central axis 17 of the ion-trap electrodes. That is, the bore size $\Phi_{in}$ of the ion inlet 13 in the end cap electrode 11 and the bore size $\Phi_{out}$ of the ion outlet 14 in the end cap electrode 12 may have the relation $\Phi_{in}=\Phi_{out}$, and the distances $z_{0in}$ and $z_0'_{out}$ from the ring electrode central point 16 to the end cap electrodes 11 and 12 may have the relation $z_0'_{in}=z_0'_{out}$. Incidentally, in this embodiment, as shown in FIG. 17, in addition to the radio-frequency voltage $V_{RF}$ cos $\Omega t$ applied to the ring electrode, a low DC voltage $\Delta V$ from a DC voltage power supply 19 is applied between the two end cap electrodes 11 and 12 to thereby generate a trapping RF electric field asymmetrically with respect to the reference plane 18. FIGS. 18 and 19 are conceptual graphs showing the potential distributions on the axis r=0 in the cases of the micro DC voltage $\Delta V>0$ and $\Delta V<0$ according to this embodiment. It is obvious that the point at which the z-direction electric field is zero is displaced from the position of the ring electrode central point 16 when the low DC voltage $\Delta V$ is applied between the two end cap electrodes 11 and 12. That is, also in this embodiment, an asymmetrical electric field with respect to the reference plane 18 can be generated. In addition, according to this embodiment, the asymmetrical electric field can be generated easily by only voltage control without intentionally making the shapes of the electrodes asymmetrical.

Figure 20:
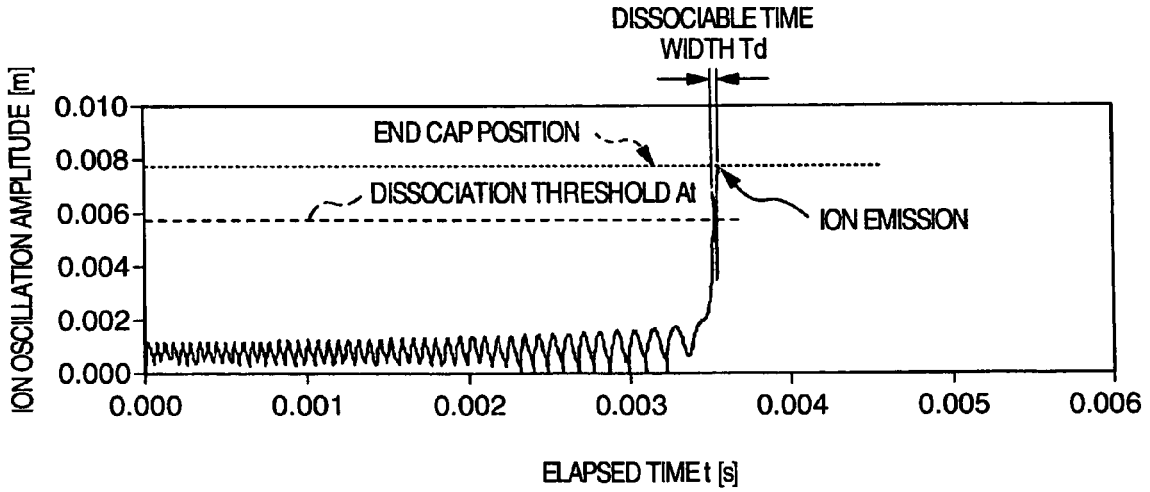
FIG. 20 is a graph for explaining a sixth embodiment of the invention.

A sixth embodiment of the invention will be described below with reference to FIG. 20. In this embodiment, the frequency $\omega/2n$ of the auxiliary AC voltage $V_d$ cos $\omega t$ applied between the two end cap electrodes 11 and 12 to resonantly emit ions trapped in the inter-electrode space is set at a value ($\omega/2\pi$ to $\Omega/6\pi$) equal or nearly equal to ⅓ as high as the frequency $\Omega/2\pi$ of the radio-frequency voltage $V_{RF}$ cos $\Omega t$ applied to the ring electrode. In this case, the point of resonance is equivalent to $\beta_z=2/3$ in the stable region in FIG. 3. That is, ions beginning to resonate approach the point of $\beta_z=2/3$ in the stable region (FIG. 3). At the point of $\beta_z=2/3$, the oscillation of ions trapped in the space between the ion-trap electrodes are amplified rapidly by a hexapole electric field so as to be destabilized. This is generally called nonlinear resonance phenomenon due to hexapole electric field. In the present invention, the haxapole electric field component is more intensive than ordinary because the trapping RF electric field generated in the space between the ion-trap electrodes is asymmetrical. Hence, it is conceived that the effect of the nonlinear resonance phenomenon due to the hexapole electric field in this invention becomes high compared with the ordinary ion trap. FIG. 20 shows results of numerical analysis of ion trajectories when the ion-trap electric field (FIGS. 10, 11 and 12) asymmetrical with respect to the reference plane 18 is generated by the same asymmetrical electrode shape (FIG. 9) as in the first embodiment of the invention and when $+v_d$ cos($\Omega t/3$) and $-v_d$ cos($\omega t/3$) are applied to the end cap electrodes 11 and 12 respectively. Also in this case, it is obvious that ions oscillation are amplified rapidly and such ions are emitted from the space between the ion-trap electrodes. Hence, according to this embodiment, mass shift due to dissociable ions can be avoided because ions can be further resonantly emitted rapidly.

Figure 21:
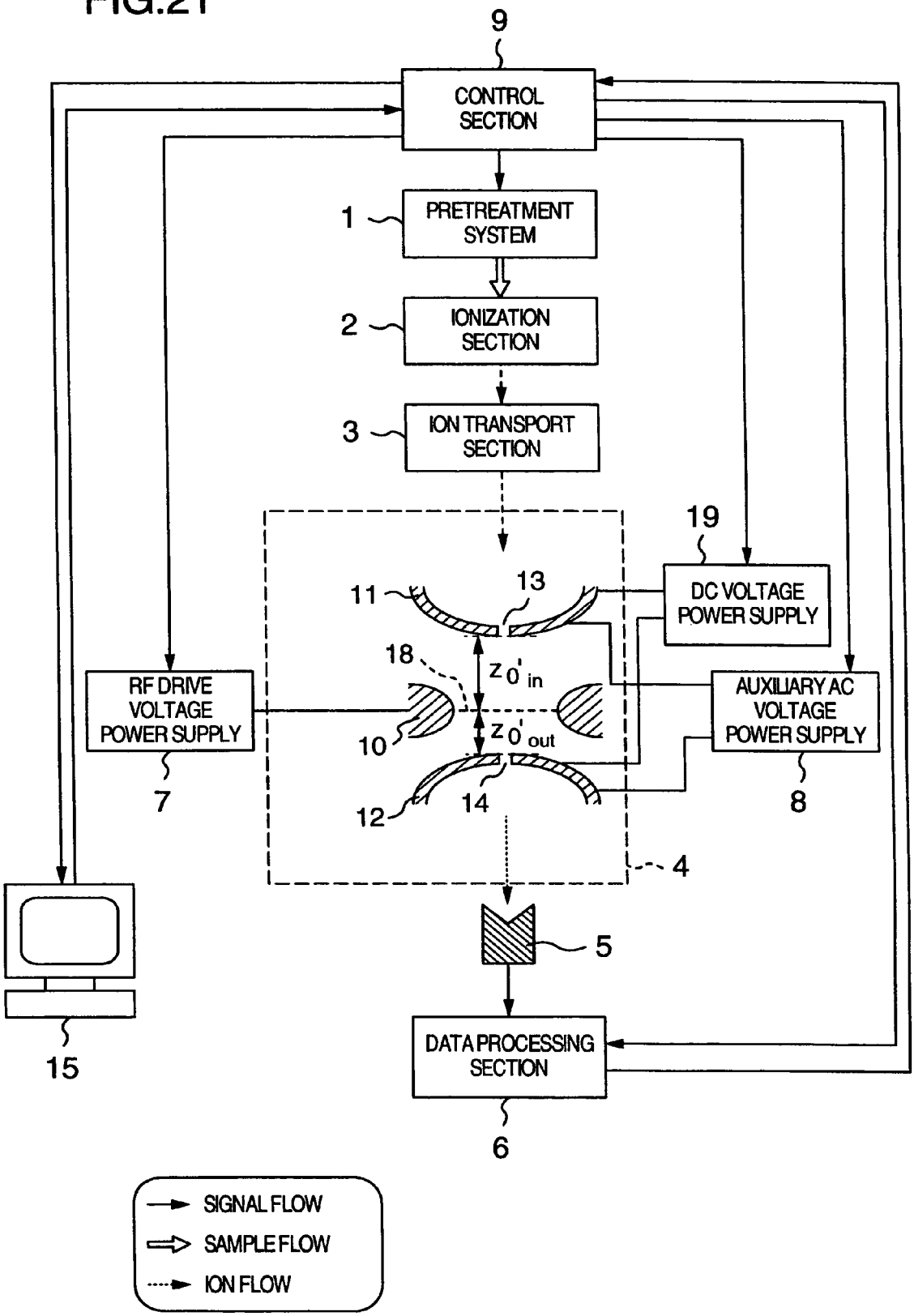
FIG. 21 is a diagram for explaining a seventh embodiment of the invention.
Figure 22:
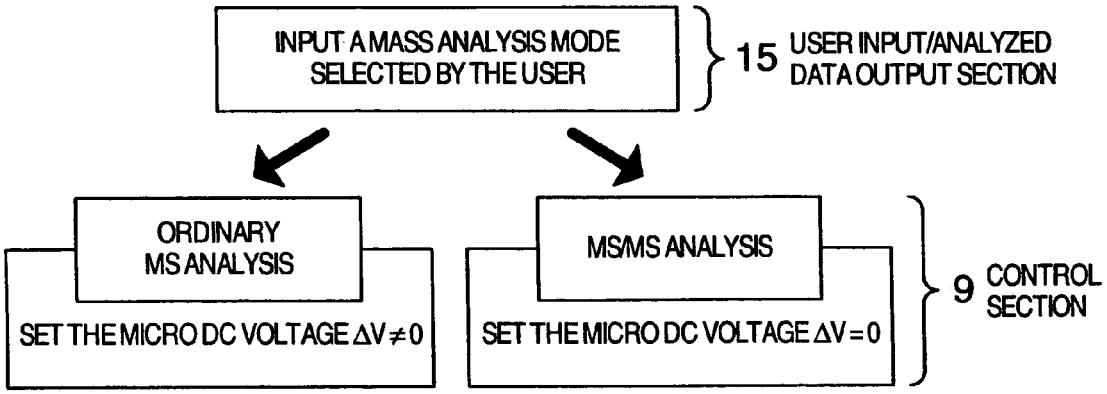
FIG. 22 is a flow chart for explaining the seventh embodiment of the invention.

A seventh embodiment of the invention will be described below with reference to FIGS. 21 and 22. FIG. 21 is a schematic view showing the overall configuration of the ion-trap mass analyzing apparatus according to this embodiment. In this embodiment, the ion-trap electrodes are shaped symmetrically in the same manner as in the fifth embodiment as shown in FIG. 17, and the DC voltage power supply 19 applies a low DC voltage $\Delta V$ between the two end cap electrodes 11 and 12 to generate an asymmetrical ion-trap electric field. In addition, in this embodiment, there is further provided a function for generating a symmetrical capture electric field in the space between the ion-trap electrodes. That is, whether or not the generated trapping RF electric field is to be symmetrical with respect to the reference plane 18 is controlled on the basis of whether the micro DC voltage $\Delta V$ is applied ($\Delta V\neq 0$) or not ($\Delta V=0$).

In the ion trap in which an ion-trap electric field symmetrical with respect to the reference plane 18 is generated as shown in FIGS. 4, 5, 6 and 7, ions oscillation are resonantly amplified gradually as shown in FIG. 8. Such a phenomenon is very effective in tandem mass analysis (MS/MS analysis) in which target ions are dissociated by collision with neutral gas so that the dissociated ions are mass-analyzed, because the probability of ions' colliding with the neutral gas becomes high. When tandem mass analysis is not used, it is however necessary to generate an asymmetrical electric field in the inter-electrode space to thereby resonantly emit ions rapidly as shown in FIG. 13 to thereby avoid occurrence of mass shift caused by dissociation of structurally dissociable ions. In this embodiment, therefore, the value of the low DC voltage $\Delta V$ is set on the basis of a mass analysis mode input through the user input section 15 to thereby control the symmetry/asymmetry of the ion-capture electric field generated in the space between the ion-trap electrodes. That is, as shown in FIG. 22 which is a control flow chart, the value of the low DC voltage is controlled by the control section 9 on the basis of the mass analysis mode input through the user input section 15 so that $\Delta V\neq 0$ is selected for ordinary MS analysis and $\Delta V=0$ is selected for tandem mass analysis. Hence, according to this embodiment, at the time of tandem mass analysis, high-sensitive analysis can be made by high-efficient dissociation of ions because a capture electric field symmetrical with respect to the reference plane 18 is generated so that ions oscillation are amplified gradually. At the time of ordinary MS analysis, mass shift can be avoided to improve mass analyzing accuracy because a trap electric field asymmetrical with respect to the reference plane 18 is generated so that ions are resonantly amplified rapidly and emitted.

Figure 23:
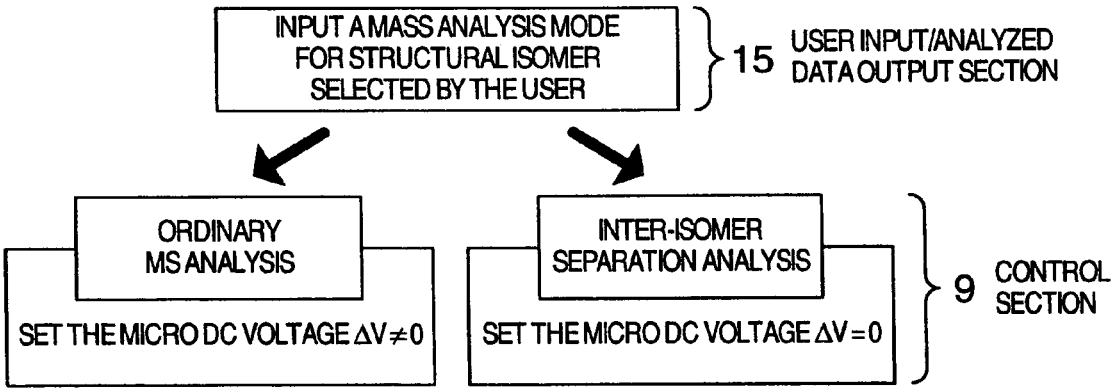
FIG. 23 is a flow chart for explaining an eighth embodiment of the invention.
Figure 24:
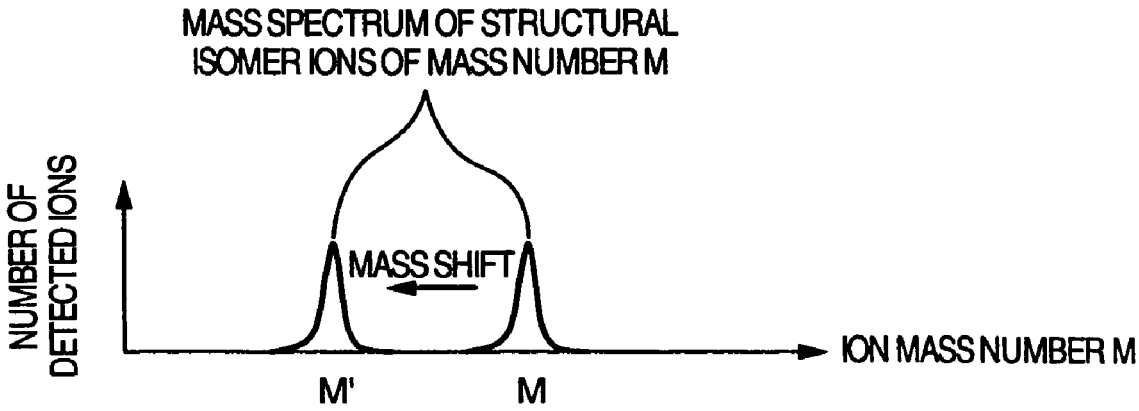
FIG. 24 is a graph for explaining the eighth embodiment of the invention.
Figure 25:
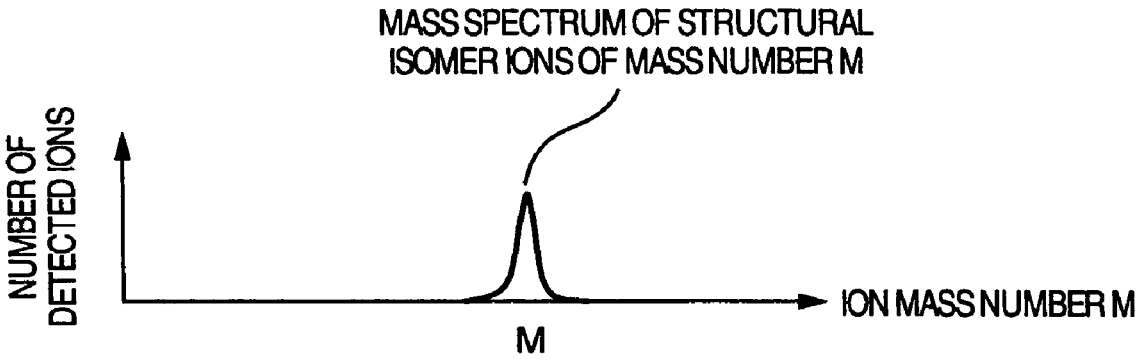
FIG. 25 is a graph for explaining the eighth embodiment of the invention.

An eighth embodiment of the invention will be described below with reference to FIGS. 23, 24 and 25. Also in this embodiment, a change-over function is provided in the same manner as the seventh embodiment for controlling the value of the low DC voltage $\Delta V$ applied between the two end cap electrodes 11 and 12 to thereby decide whether the ion-trap electric field generated in the inter-electrode space is to be symmetrical or asymmetrical with respect to the reference plane 18. The changing-over is, however, judged on the basis of whether structural isomers are analyzed or not. The structural isomers are ions the same in mass number but different in structure. The structural isomers are often different in structural stability from each other, so that the structural isomers are different in dissociability. When such ions are a target of ordinary MS analysis, it is necessary to resonantly emit the ions in substantially the same timing so that the ions can be observed as the same mass. If ions are resonantly amplified in motion gradually as shown in FIG.

8, one dissociable isomer is dissociated by collision with neutral gas so that the dissociable ions are emitted earlier than the other isomer ions. As a result, ions which are supposed to inherently have a peak at the same mass number point have mass peaks at different points (FIG. 24). On this occasion, there is a fear that ions having the same mass number may be misjudged as ions having different mass numbers. Therefore, when structural isomers are subjected to ordinary MS analysis, the low DC voltage is set at $\Delta V \neq 0$ to make the capture electric field generated in the inter-electrode space asymmetrical to thereby resonantly emit ions rapidly as shown in FIG. 13 to avoid mass shift (FIG. 25).

On the other hand, when structural isomer ions are to be separated/analyzed in such a manner that the structural isomer ions are classified into structurally dissociable ions and structurally indissociable ions after only the structural isomer ions are captured (isolated) in the space between the ion-trap electrodes, the micro DC voltage is set at $\Delta V = 0$ to make the trapping RF electric field generated in the inter-electrode space symmetrical to thereby amplify the structural isomer ions gradually as shown in FIG. 8 to increase the probability of the ions' colliding with the neutral gas. On this occasion, the isomer ions can be separated by dissociability (FIG. 24). That is, as shown in FIG. 23 which is a control flow chart, the value of the low DC voltage is controlled by the control section 9 on the basis of the isomer mass analysis mode input through the user input section 15 so that $\Delta V \neq 0$ is selected for ordinary MS analysis and $\Delta V = 0$ is selected for inter-isomer separation analysis. Hence, according to this embodiment, inter-isomer separation analysis which is generally taboo to the mass analyzing apparatus can be avoided and can be conversely used for isomer separation. It will be understood that the potential of structural analysis in the mass analyzing apparatus can be widened.

Figure 26:
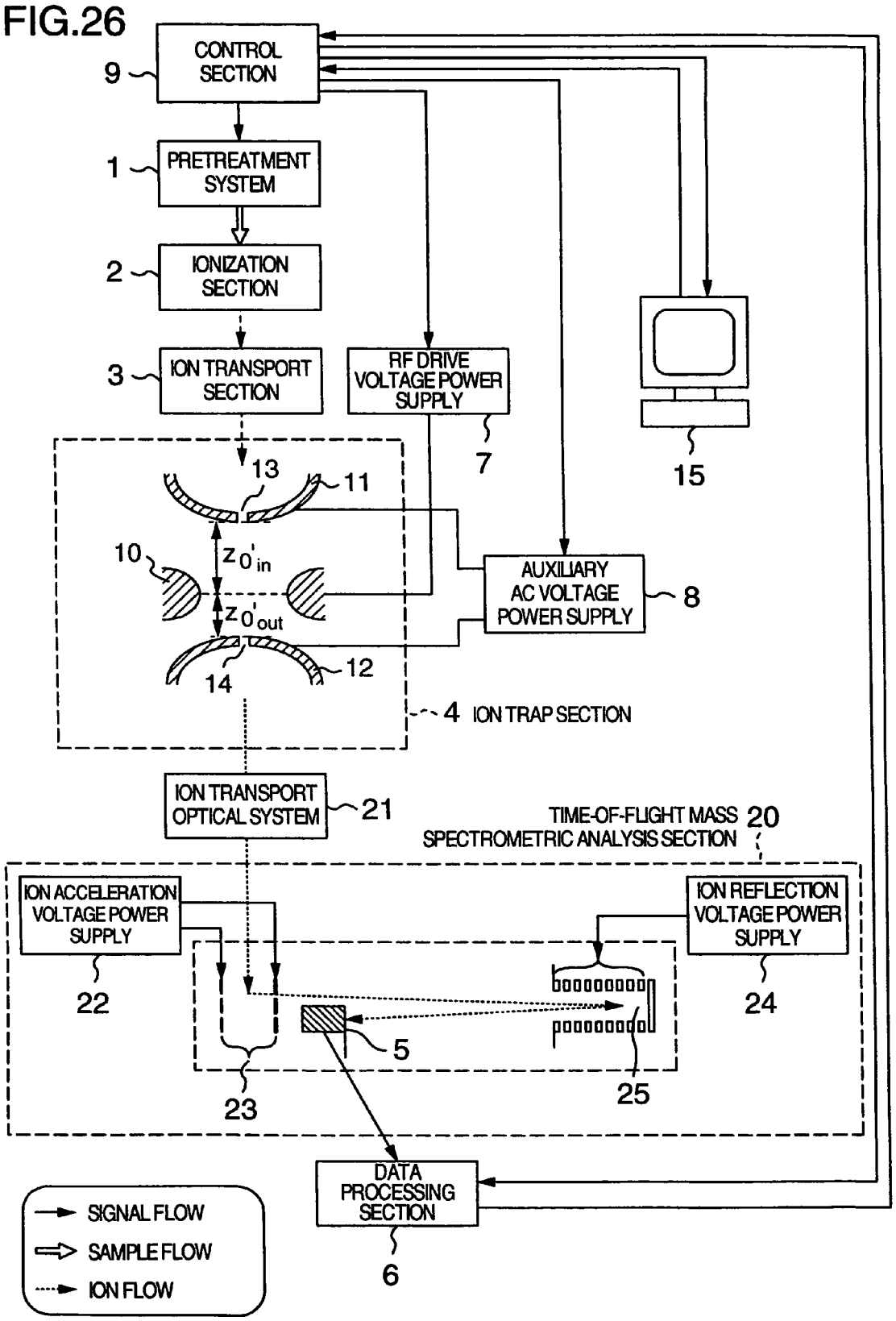
FIG. 26 is a diagram for explaining a ninth embodiment of the invention.

A ninth embodiment of the invention will be described below with reference to FIG. 26. FIG. 26 is a schematic diagram showing the overall configuration of the ion-trap mass analyzing apparatus according to this embodiment. In this embodiment, a time-of-flight mass spectrometric analysis (TOF-MS) section 20 is connected to the downstream side of the ion-trap mass analysis section 4 having a trap electric field distribution asymmetrical with respect to the reference plane 18. In this embodiment, the ion-trap mass analysis section 4 is mainly used for collecting sample ions from an ion source. The ions collected by the ion-trap mass analysis section 4 pass through an ion transport optical system 21 and enter an ion acceleration region 23 in the TOF-MS section 20. An ion acceleration voltage power supply 22 applies an acceleration voltage to the ion acceleration region 23 to generate an ion acceleration electric field in the ion acceleration region 23. After the accelerated ions fly in a field-free flight region at different velocities in accordance with the mass numbers respectively, an electric field in a direction reserve to the direction of movement of the ions is applied to the ions in an ion reflection region 25 in which a reflection electric field is generated by an ion reflection voltage power supply 24. As a result, the ions fly in the field-free flight region again in the reverse direction. Thus, the ions are detected by the detector 5. On this occasion, because the time of flight varies in accordance with the mass number of ions, data is processed as a result of mass separation according to the time of flight by the data processing section 6. Particularly the capture electric field generated in the space between the ion-trap electrodes is made asymmetrical to emit ions rapidly when ions collected by the ion-trap mass analysis section 4 are to be ejected. Hence, error in the time of flight due to difference in ion-emission timing can be reduced. It is also conceived that high-sensitive mass analysis of high-mass-number ions which can be hardly performed by the ion-trap mass analysis section 4 alone can be performed according to this embodiment. The TOF-MS section 20 may be of a reflection type or may be of a linear type.

As described above, because the ion-trap electric field generated in the space between the ion-trap electrodes is made asymmetrical with respect to the reference plane containing the central point of the ring electrode and perpendicular to the central axis of the ring electrode, ions can be resonantly emitted rapidly. Hence, results of high-accurate high-sensitive mass analysis can be obtained stably while mass shift caused by structural stability of ions is avoided.

According to the invention, there is provided an ion-trap mass analyzing apparatus which can perform high-sensitive high-accurate mass analysis stably.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. An ion-trap mass analyzing apparatus comprising:

an annular ring electrode, an inlet side end cap electrode which has an ion inlet aperture and an outlet side end cap electrode wherein said ion outlet aperture and said outlet side end cap electrode are opposed to each other so as to sandwich said ring electrode, a first voltage power supply for applying voltage to said ring electrode, and a second voltage power supply for applying voltage to said inlet side end cap electrode and outlet side end cap electrode, wherein said inlet side end cap electrode and said outlet side electrode are formed asymmetrically with respect to a reference plane, and wherein an absolute value of voltage applied to said inlet side end cap electrode and an absolute value of voltage applied to said outlet side end cap electrode are substantially equal.

2. An ion-trap mass analyzing apparatus according to claim 1, wherein the diameter of said ion inlet aperture is larger than the diameter of said ion outlet aperture.

3. An ion-trap mass analyzing apparatus according to claim 1;

wherein the distance from said reference plane to said inlet side end cap electrode is longer than the distance from said reference plane to said outlet side end cap electrode.

4. An ion-trap mass analyzing apparatus comprising:

an annular ring electrode, an inlet side end cap electrode which has an ion inlet aperture and an outlet side end cap electrode wherein said ion outlet aperture and said outlet side end cap electrode are opposed to each other so as to sandwich said ring electrode, a first voltage power supply for applying voltage to said ring electrode;

a second voltage power supply for applying voltage to said inlet side end cap electrode and outlet side end cap electrode;

wherein an absolute value of voltage applied to said inlet side end cap electrode and an absolute value of voltage applied to said outlet side end cap electrode are substantially equal, and wherein said apparatus further includes a function for switching electric field distribution among said inlet side end cap electrode, said outlet side end cap electrode and said ring electrode, from an asymmetrical electric field distribution to a symmetrical electric field distribution.

5. An ion-trap mass analyzing apparatus according to claim 4, wherein said inlet side end cap electrode and said outlet side end cap electrode are formed asymmetrically with respect to a reference plane.

* * * * *